US010268154B2

(12) United States Patent
Ohsugi

(10) Patent No.: US 10,268,154 B2
(45) Date of Patent: Apr. 23, 2019

(54) TONER CONVEYANCE DEVICE INCLUDING A TONER LOOSENER AND IMAGE FORMING APPARATUS INCLUDING THE TONER CONVEYANCE DEVICE

(71) Applicant: Tatsuya Ohsugi, Kanagawa (JP)

(72) Inventor: Tatsuya Ohsugi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/969,846

(22) Filed: May 3, 2018

(65) Prior Publication Data

US 2018/0341200 A1 Nov. 29, 2018

(30) Foreign Application Priority Data

May 25, 2017 (JP) ..... 2017-103507

(51) Int. Cl.
*G03G 21/00* (2006.01)
*G03G 21/10* (2006.01)
*G03G 15/16* (2006.01)

(52) U.S. Cl.
CPC ..... *G03G 21/105* (2013.01); *G03G 15/161* (2013.01); *G03G 2221/1624* (2013.01)

(58) Field of Classification Search
CPC ..... G03G 15/087; G03G 15/161; G03G 15/1615; G03G 15/0891; G03G 15/0889; G03G 21/105; G03G 2215/0802; G03G 2215/0827; G03G 2215/1647; G03G 2215/1661; G03G 2221/0026; G03G 2221/1624
USPC ..... 399/256, 261, 358
See application file for complete search history.

(56) References Cited

U.S. PATENT DOCUMENTS 9,037,070 B2 * 5/2015 Tokuda ..... G03G 21/105 399/358
9,176,455 B2 * 11/2015 Fujii ..... G03G 21/105
2010/0247191 A1 * 9/2010 Ichikawa ..... G03G 15/0877 399/358
2013/0266344 A1 * 10/2013 Leemhuis ..... G03G 15/0889 399/256

(Continued)

FOREIGN PATENT DOCUMENTS

JP 06167880 A * 6/1994
JP 2005-037481 2/2005

(Continued)

*Primary Examiner* — Robert B Beatty
(74) *Attorney, Agent, or Firm* — Harness, Dickey & Pierce, P.L.C.

(57) ABSTRACT

A toner conveyance device includes a conveyance path including a flowing-in portion to receive toner and a discharge portion to discharge the toner, a conveying screw to convey the toner from the flowing-in portion to the discharge portion, and a toner loosener disposed in at least one of the flowing-in portion and the discharge portion. The toner loosener includes at least one loosening portion to be vibrated by contact with the conveying screw and a support to cantilever the loosening portion. The loosening portion includes a first contact portion and a second contact portion disposed farther than the first contact portion from the support. A distance from the support to the second contact portion is longer than a distance from the support to the first contact portion in a longitudinal direction of the conveying screw.

16 Claims, 8 Drawing Sheets

(56) References Cited

U.S. PATENT DOCUMENTS

| | | | | |
|---|---|---|---|---|
| 2015/0078795 | A1* | 3/2015 | Kuwabara | G03G 21/105<br>399/358 |
| 2016/0342129 | A1* | 11/2016 | Matsumoto | G03G 21/0011 |
| 2017/0269511 | A1* | 9/2017 | Tomita | G03G 15/0889 |
| 2017/0343953 | A1* | 11/2017 | Oi | G03G 21/0011 |

FOREIGN PATENT DOCUMENTS

| | | | | | |
|---|---|---|---|---|---|
| JP | 2005077675 | A | * | 3/2005 | |
| JP | 2008040362 | A | * | 2/2008 | |
| JP | 2008-268574 | | | 11/2008 | |
| JP | 2011022238 | A | * | 2/2011 | |
| JP | 2012-083402 | | | 4/2012 | |
| JP | 2013020209 | A | * | 1/2013 | G03G 15/0879 |
| JP | 2014160163 | A | * | 9/2014 | |

* cited by examiner

TONER CONVEYANCE DEVICE INCLUDING A TONER LOOSENER AND IMAGE FORMING APPARATUS INCLUDING THE TONER CONVEYANCE DEVICE

CROSS-REFERENCE TO RELATED APPLICATIONS

This patent application is based on and claims priority pursuant to 35 U.S.C. § 119(a) to Japanese Patent Application No. 2017-103507, filed on May 25, 2017, in the Japan Patent Office, the entire disclosure of which is hereby incorporated by reference herein.

BACKGROUND

Technical Field

This disclosure generally relates to a toner conveyance device and an image forming apparatus.

Description of the Related Art

Electrophotographic image forming apparatuses generally include a cleaning device to remove toner remaining on a photoconductor or an intermediate transfer belt and a waste-toner conveyance unit. Through a conveyance path of the waste-toner conveyance unit, a rotatable conveyor such as a conveying screw conveys the waste toner to a destination.

Currently, small diameter toner has been developed to attain high image quality, and melting point of toner has been lowered to improve productivity of image printing. As toner size is reduced and the melting point is lowered, flowability (fluidity) of toner deteriorates. Accordingly, in a joint between units for conveying the toner, there is a risk of aggregation, adhesion, and cross linkage of toner and clogging of the conveyance path.

SUMMARY

According to an embodiment of this disclosure, a toner conveyance device includes a conveyance path including a flowing-in portion to receive toner and a discharge portion to discharge the toner, a conveying screw to convey the toner from the flowing-in portion to the discharge portion, and a toner loosener disposed in at least one of the flowing-in portion and the discharge portion. The toner loosener includes at least one loosening portion to be vibrated by contact with the conveying screw and a support to cantilever the loosening portion. The loosening portion includes a first contact portion and a second contact portion disposed farther than the first contact portion from the support. A distance from the support to the second contact portion is longer than a distance from the support to the first contact portion in a longitudinal direction of the conveying screw.

According to another embodiment, a toner conveyance device includes the above-described conveyance path, a first conveying screw to convey the toner from the flowing-in portion to the discharge portion, a cleaning unit to collect toner from an image bearer, and a second conveying screw to convey toner in the cleaning unit. The cleaning unit is disposed upstream from the flowing-in portion in a toner conveyance direction in the toner conveyance device. The toner conveyance device further includes a toner loosener disposed on a side of the cleaning unit in the flowing-in portion. The toner loosener includes at least one loosening portion to be vibrated by contact with the second conveying screw, and a support to cantilever the loosening portion. The at least one loosening portion includes a first contact portion and a second contact portion disposed farther than the first contact portion from the support. A distance from the support to the second contact portion is longer than a distance from the support to the first contact portion in a longitudinal direction of the second conveying screw.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
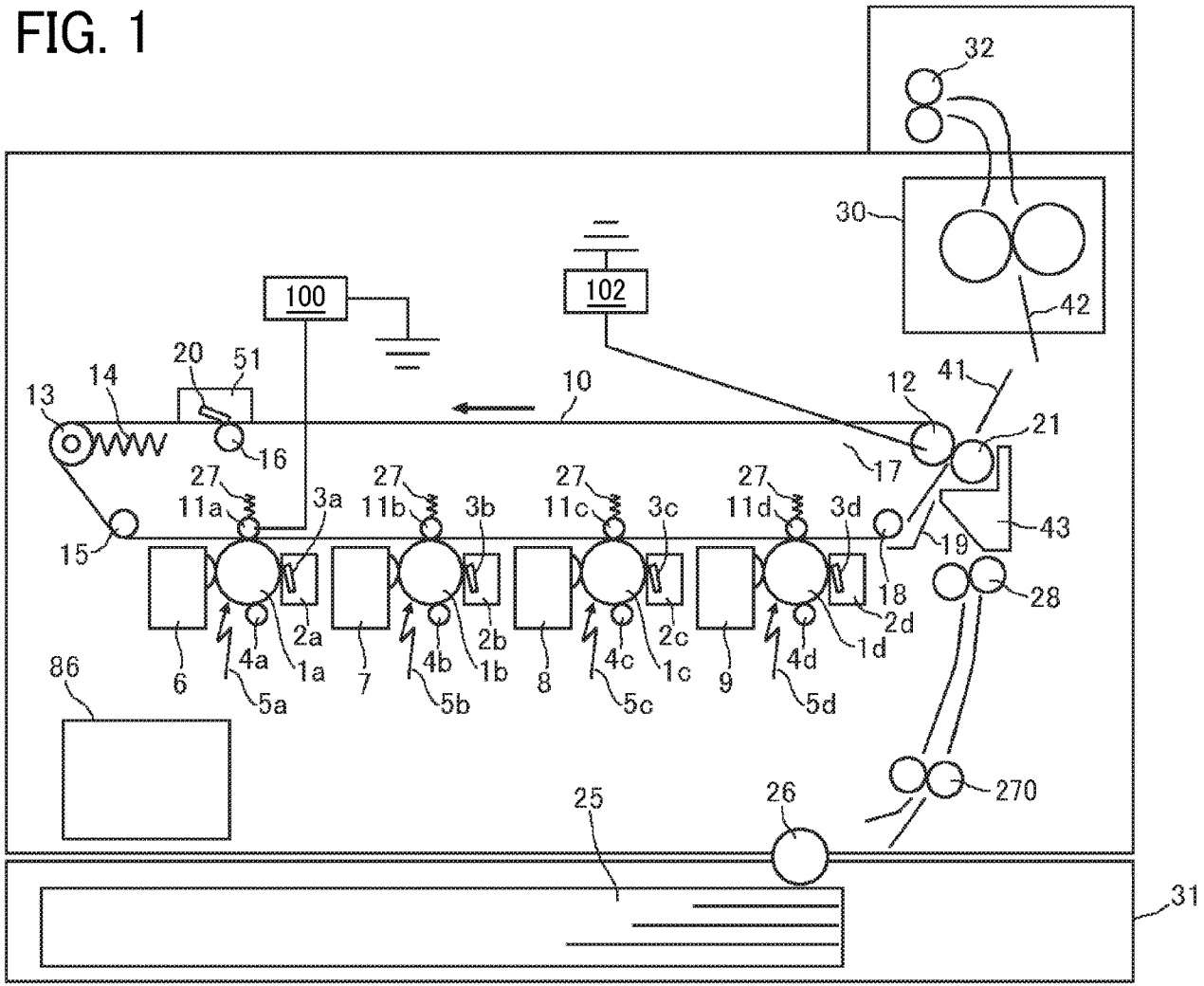
FIG. 1 is a schematic view of an image forming apparatus according to an embodiment of this disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

FIG. 1 is a schematic view of the image forming apparatus according to the present embodiment.

The image forming apparatus illustrated in FIG. 1 includes four image forming units respectively including photoconductors 1*a*, 1*b*, 1*c*, and 1*d* (collectively photoconductors 1). Around the photoconductors 1*a*, 1*b*, 1*c*, and 1*d*, photoconductor cleaning units 2*a*, 2*b*, 2*c*, and 2*d*; charging devices 4*a*, 4*b*, 4*c*, and 4*d*; exposure devices 5*a*, 5*b*, 5*c*, and 5*d*; and developing devices 6, 7, 8, and 9 are disposed, respectively. Further, an intermediate transfer belt 10 (an image bearer) to bear a toner image is disposed above these components. The four developing devices 6, 7, 8, and 9 are used to form yellow, magenta, cyan, and black images, respectively. To form full-color images, the yellow developing device 6, the magenta developing device 7, the cyan developing device 8, and the black developing device 9 form visible images in that order. As the respective color images are sequentially transferred from the photoconductors 1 and deposited one on another on the intermediate transfer belt 10, a full-color image is formed. The photoconductor cleaning unit 2 includes a blade 3 to remove toner from the photoconductor 1.

Note that, in FIG. 1, subscripts a, b, c, and d attached to reference numerals indicate only that components indicated thereby are used for forming yellow, magenta, cyan, and black images, respectively. Since the component structures are common among these colors, subscripts a, b, c, and d are omitted when color discrimination is not necessary.

The four image forming units for yellow, magenta, cyan, and black are arranged side by side along the direction of rotation of the intermediate transfer belt 10 and together form a tandem image forming device.

In each image forming unit, the charging device 4 charges the surface of the photoconductor 1 serving as an image bearer, and the exposure device 5 forms an electrostatic latent image thereon. Then, the developing devices 6, 7, 8, and 9 develop the electrostatic latent images into toner images, respectively. Subsequently, transfer rollers 11*a*, 11*b*, 11*c*, and 11*d* (primary transfer devices) transfer the toner images onto the intermediate transfer belt 10 disposed opposite the photoconductors 1*a*, 1*b*, 1*c*, and 1*d*, respectively. The photoconductor cleaning unit 2 contains the blade 3, which contacts the photoconductor 1 in the direction against rotation of the photoconductor 1, and collects residual toner from the photoconductor 1 therein, after the transferring. The toner is collected in a waste-toner container 86. Additionally, toner collected from the intermediate transfer belt 10 is contained in the waste-toner container 86.

Figure 2A:
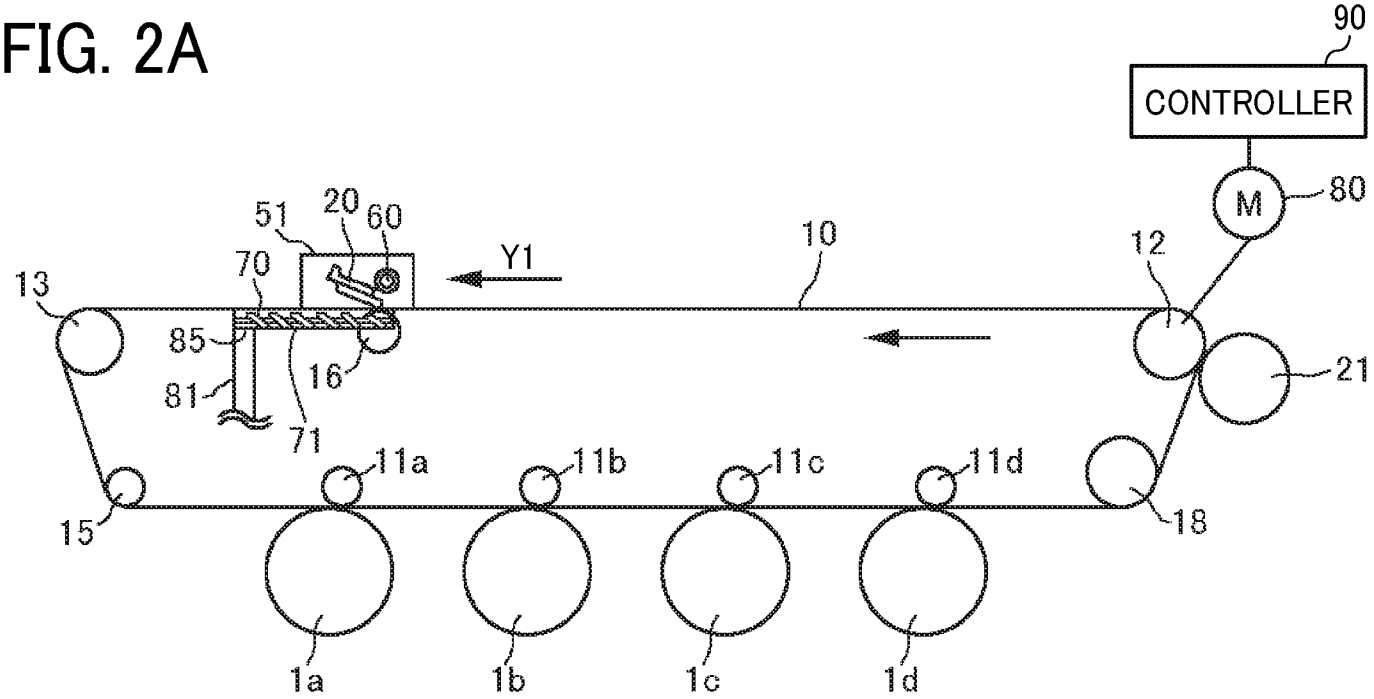
FIGS. 2A, 2B, and 2C are schematic cross-sectional views of a belt cleaning unit according to an embodiment.

The intermediate transfer belt 10 is looped around a secondary-transfer backup roller 12, a tension roller 13 urged by a spring 14, and tension rollers 15 and 18 and rotates counterclockwise in FIG. 1, as indicated by an arrow. Specifically, as illustrated in FIG. 2A, a drive motor 80 is coupled to the secondary-transfer backup roller 12, and a controller 90 to control the drive motor 80 is operably connected to the drive motor 80. Accordingly, the secondary-transfer backup roller 12 is a roller to rotate together with the intermediate transfer belt 10 that is rotated by the secondary-transfer backup roller 12 driven by the drive motor 80. The primary transfer roller 11 is disposed inside the loop of the intermediate transfer belt 10 and at a position where the intermediate transfer belt 10 contacts the photoconductor 1. The primary transfer roller 11 is biased by a spring 27. To the primary transfer roller 11, a voltage application device 100 applies a predetermined primary transfer bias. In FIG. 1, only the voltage application device 100 for the transfer roller 11*a* is illustrated and those for the transfer rollers 11*b*, 11*c*, and 11*d* are omitted for simplicity.

The intermediate transfer belt 10 is an endless belt with single or multiple layers of materials such as polyvinylidene fluoride (PVDF), ethylene tetrafluoroethylene (ETFE), polyimide (PI), polycarbonate (PC), polyamideimide (PAI) or the like. A conductive substance such as carbon black is dispersed in a such material to adjust the volume resistivity to a range of $10^8$ to $10^{12}$ Ωcm and the surface resistivity to a range of $10^9$ to $10^{13}$ Ω/sq. As necessary, the surface (on the outer side of the loop thereof) of the intermediate transfer belt 10 can be coated to form a release layer. Example materials for the coat are, but not limited to, fluoroplastics such as ethylene-tetrafluoroethylene copolymer (ETFE), polytetrafluoroethylene (PTFE), polyvinylidene fluoride (PVDF), perfluoroalkoxy (PFA) fluoroplastic, tetrafluoroethylene-hexafluoropropylene copolymer (FEP), and polyvinyl fluoride (PVF). Example manufacturing methods of the intermediate transfer belt 10 include, but not limited to, casting and centrifugal molding. As necessary, the surface of the intermediate transfer belt 10 can be polished.

When the volume resistivity of the intermediate transfer belt 10 exceeds the above-mentioned range, the bias necessary for transfer becomes high, which leads to an unfavorable increase in electric power cost. In this case, the intermediate transfer belt 10 has a high charge potential in the transfer process and the recording sheet separation process, and self discharge of the intermediate transfer belt 10 becomes difficult. Accordingly, the intermediate transfer belt 10 would need a discharger. When the volume resistivity and the surface resistivity fall below the above-mentioned ranges, the charge potential of the intermediate transfer belt 10 is more quickly attenuated, which is advantageous for static elimination by self discharge. However, the electric current flows in a planar direction at the time of transfer and undesirably promotes the scattering of toner. Accordingly, the above-described ranges of volume resistivity and surface resistivity are preferred for the intermediate transfer belt 10 according to the present embodiment. Note that the volume resistivity and the surface resistivity can be measured as follows. A high resistance resistivity meter (Hiresta produced by Mitsubishi Kasei Corporation) is coupled to an HRS probe (the inside electrode has a diameter of 5.9 mm and the ring electrode has an inner diameter of 11 mm), and a voltage of 100V (500V for measurement of the surface resistivity) to the front and back sides of the intermediate transfer belt 10. The measurement value after 10 seconds from application of the voltage is used.

The image forming apparatus further includes a belt cleaning unit 51 to clean the intermediate transfer belt 10. The belt cleaning unit 51 is described later with reference to FIGS. 2A to 2C.

Additionally, a secondary transfer roller 21 serving as a secondary transfer device is disposed at a position opposite the secondary-transfer backup roller 12 via the intermediate transfer belt 10. The secondary transfer roller 21 includes a core shaft made of metal, such as Steel Special Use Stainless (SUS) according to Japan Industrial Standard (JIS), and an elastic body overlying the core. The elastic body is, for example, made of urethane, and adjusted to have a resistance value from $10^6$ to $10^{10}$Ω with a conductivity material. If the resistance value of the secondary transfer roller 21 exceeds the above-mentioned range, flow of electric current is inhibited. Then, application of higher voltage is required to attain a desirable transfer performance, and the cost of the power supply increases. Additionally, due to the application of high voltage, electrical discharge occurs in gaps between the nip formed by the secondary transfer roller 21, and the electrical discharge causes white spots (where toner is absent) in a halftone image. By contrast, if the resistance value of the secondary transfer roller 21 is lower than the above-mentioned range, transfer performance is not balanced between a multicolor image portion (e.g., a three-color superimposed image) and a single-color image portion. This is caused as follows. Since the resistance value of the secondary transfer roller 21 is low, a sufficient current for transferring single-color images flows with a relatively low voltage. Transfer of multicolor images, however, requires voltage higher than the voltage suitable for transferring single-color images. Accordingly, if the transfer voltage is set for a value suitable for transferring multicolor images, the transfer current is excessive for transferring single-color images, degrading transfer efficiency.

Note that the resistance value of the secondary transfer roller 21 can be measured as follows. Dispose the secondary transfer roller 21 on a conductive metal plate, apply a voltage of 1000 V to a portion between the core shaft and the metal plate in a state where a load of 4.9 N is applied to each end of the core shaft (9.8 N in total), and calculate the resistance value from the current flowing at that time. The secondary transfer roller 21 is pressed against the secondary-transfer backup roller 12 to rotate as the secondary-transfer backup roller 12 rotates. To the secondary-transfer backup roller 12, a voltage application device 102 applies a secondary transfer bias to transfer the toner image from the intermediate transfer belt 10 onto a recording medium 25 at a secondary transfer position (a secondary transfer nip) between the secondary transfer roller 21 and the secondary-transfer backup roller 12. In the present embodiment, the constant-current control is performed.

Above the secondary transfer roller 21, a fixing device 30 to fix, on the recording medium 25, the toner image secondarily transferred thereonto is disposed. The fixing device 30 includes a fixing roller and a pressure roller pressed against the fixing roller.

The image forming apparatus configured as described above operates as follows.

When a user presses a start switch of the image forming apparatus, according to a signal transmitted from the controller 90, the drive motor 80 (illustrated in FIG. 2A) rotates the secondary-transfer backup roller 12. Then, other rollers are rotated, and the intermediate transfer belt 10 rotates. At the same time, in the image forming units, the photoconductors 1 are rotated, and single-color toner images of yellow, magenta, cyan, and black are formed on the photoconductors 1, respectively. While the intermediate transfer belt 10 rotates, the transfer bias is applied to the primary transfer rollers 11, and the single-color toner images on the photoconductors 1 are sequentially transferred onto the intermediate transfer belt 10, thus forming a multicolor toner image (a synthesized color image).

Meanwhile, as the start switch is pressed, in a sheet feeder 31, one of feed rollers 26 is selectively driven so that the recording medium 25 is fed from the corresponding one of sheet trays. Then, a separation roller separates one recording medium 25 from the sheet tray and feed the recording medium 25 to a sheet feeding path. Then, the recording medium 25 is transported by a conveyance roller 270 inside the apparatus body along the sheet feeding path and stopped by the registration roller pair 28.

Subsequently, the registration roller pair 28 rotates to send the recording medium 25 to the nip between the intermediate transfer belt 10 and the secondary transfer roller 21, timed to coincide with the synthesized color image on the intermediate transfer belt 10. Then, the secondary transfer roller 21 transfers the toner image onto the recording medium 25. The image forming apparatus further includes a transfer-entry assist 43 to guide the recording medium 25 conveyed along a transfer-entry guide 19 at that time. Note that the transfer bias can be applied either the secondary transfer roller 21 or the secondary-transfer backup roller 12.

After the four-color superimposed image is transferred onto the recording medium 25 in the nip between the secondary transfer roller 21 and the secondary-transfer backup roller 12, the secondary transfer roller 21 forwards the recording medium 25 to a transfer-exit guide 41 and a fixing-entry guide 42 to be conveyed to the fixing device 30. In the fixing device 30, the fixing roller and the pressure roller apply heat and pressure to the recording medium 25 to fix the multicolor toner image thereon, after which a sheet ejection roller pair 32 discharges the recording medium 25.

Meanwhile, after image transfer, the belt cleaning unit 51 removes residual toner from the intermediate transfer belt 10, and the intermediate transfer belt 10 is prepared for subsequent image formation by the tandem image forming device.

Figure 2B:
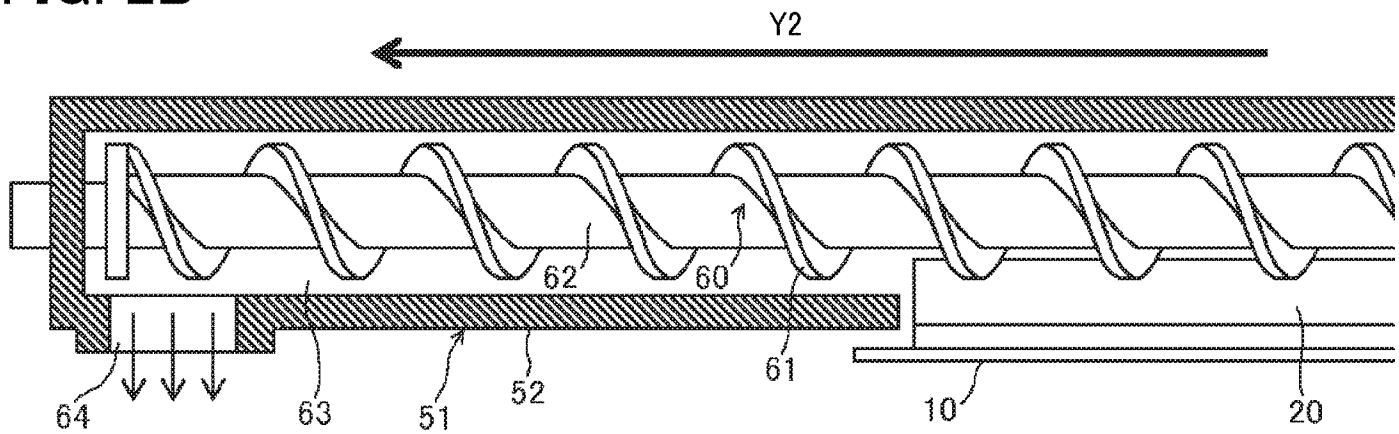
Figure 2C:
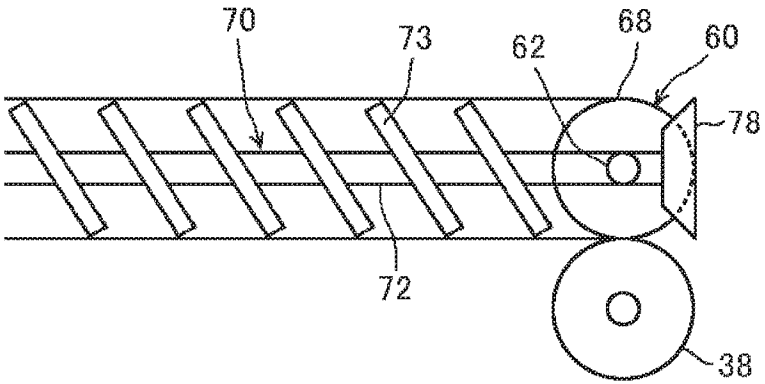

FIGS. 2A, 2B, and 2C are schematic cross-sectional views of the belt cleaning unit 51 according to the present embodiment.

FIG. 2A is a cross-sectional view of the belt cleaning unit 51 as viewed from the front side of the apparatus. FIG. 2B is an enlarged cross-sectional view of the belt cleaning unit 51, as viewed in the direction indicated by arrow Y1 in FIG. 2A. FIG. 2C is a schematic view of a power transmission mechanism for the belt cleaning unit 51 and a waste-toner conveyance unit 71.

The belt cleaning unit 51 removes toner remaining on the intermediate transfer belt 10 (i.e., an image bearer) after image transfer. The belt cleaning unit 51 is a part of a toner conveyance device according to this disclosure. As illustrated in FIG. 2B, the belt cleaning unit 51 includes a cleaning blade 20 (i.e., a cleaner) made of urethane rubber and a conveying screw 60 disposed inside a case 52. The conveying screw 60 conveys the toner, removed by the cleaning blade 20, toward an outlet 64 (i.e., a discharge portion). The case 52 defines a conveyance path 63 through which the toner is conveyed. At an end of the conveyance path 63, the outlet 64 of the belt cleaning unit 51, from which toner falls, is disposed. The conveying screw 60 includes a cylindrical shaft 62 and a blade 61 spirally projecting from the shaft 62, in the radial direction thereof.

In FIG. 2A, the intermediate transfer belt 10 rotates counterclockwise, and the cleaning blade 20 contacts the intermediate transfer belt 10 in the direction against the rotation thereof. Accordingly, the residual toner on the intermediate transfer belt 10 is gathered and cleaned by the cleaning blade 20. Note that, instead of a urethane rubber blade used as the cleaning blade, a conductive brush or roller can be used to electrostatically collect the residual toner.

As the conveying screw 60 rotates, the toner removed from the intermediate transfer belt 10 by the cleaning blade 20 is conveyed down to the waste-toner conveyance unit 71 disposed below the belt cleaning unit 51. Then, the toner falls from an outlet 85 (a discharge portion from the waste-toner conveyance unit 71) to a duct 81 and is stored in the waste-toner container 86 (illustrated in FIG. 1) communicating with the duct 81. The waste-toner container 86 is disposed in a lower section of the image forming apparatus. The waste-toner container 86 includes a detector to detect the amount of toner collected. When the waste toner container is full, the image forming apparatus stops based on a detection result from the detector, preventing overflow of toner.

Further, a cleaning backup roller 16 is disposed opposite the cleaning blade 20 and inside the loop of the intermediate transfer belt 10 so that the cleaning blade 20 tightly contacts the intermediate transfer belt 10. As illustrated in FIG. 2B, the conveying screw 60 extends outward beyond the intermediate transfer belt 10 and the cleaning blade 20 in the width direction (the lateral direction in FIG. 2B) perpendicular to the direction of rotation of the intermediate transfer belt 10. The rotatable conveying screw 60 conveys the waste toner removed from the intermediate transfer belt 10 by the cleaning blade 20 inside the conveyance path 63 of the belt cleaning unit 51 in the direction indicated by arrow Y2 (toward the front side of the apparatus). Then, the waste toner is received from the outlet 64 of the conveyance path 63 to the waste-toner conveyance unit 71 disposed below the belt cleaning unit 51 and is further conveyed downstream by a conveying screw 70 disposed inside the waste-toner conveyance unit 71.

As described above, the intermediate transfer belt 10 is rotated by the secondary-transfer backup roller 12 driven by the drive motor 80, and the cleaning backup roller 16 follows rotation of the intermediate transfer belt 10 due to friction of contact with the intermediate transfer belt 10.

By contrast, as illustrated in FIG. 2C, a gear 68 is attached to an end of the shaft 62 of the conveying screw 60. The gear 68 meshes with a gear 38 disposed at an end of the cleaning backup roller 16 that rotates as the intermediate transfer belt 10 rotates. Accordingly, the conveying screw 60 receives a driving force from the cleaning backup roller 16. Further, a gear 78 is disposed at an end of a shaft 79 of the conveying screw 70, and the gear 78 meshes with a gear 68. Accordingly, the conveying screw 70 receives the driving force from the gear 68 of the conveying screw 60.

In this configuration, after a print job completes, the controller 90 causes the drive motor 80 to reversely rotate the secondary-transfer backup roller 12 so as to reversely rotate the intermediate transfer belt 10 by, for example, 2 mm, thereby discharging the toner and the like accumulating on the cleaning blade 20 to the upstream side of the cleaning blade 20. This action can prevent the toner and the like from accumulating in a given portion of the cleaning blade 20. Then, the toner and the like is prevented from penetrating through the cleaning blade 20.

FIGS. 3A to 3D and FIG. 4 are schematic cross-sectional views of an agitator 72 disposed at a joint 75 between the belt cleaning unit 51 and the waste-toner conveyance unit 71 according to the present embodiment.

Figure 3A:
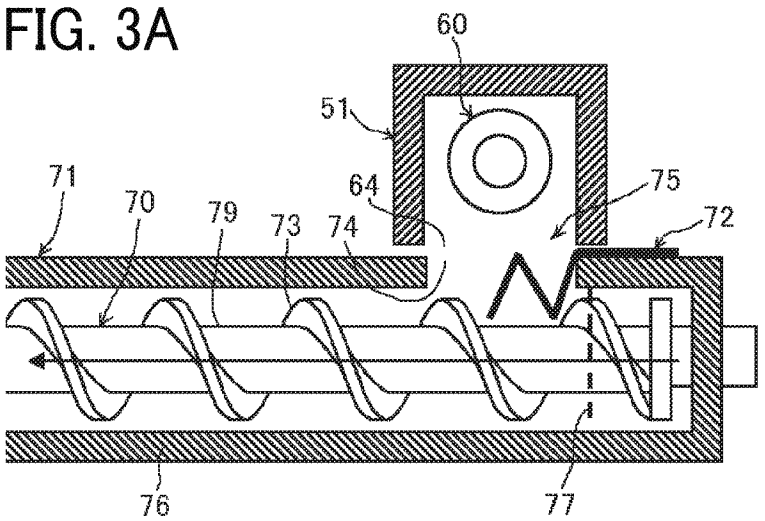
FIGS. 3A to 3D are schematic cross-sectional views of an agitator disposed at a joint between the belt cleaning unit illustrated in FIGS. 2A to 2C and a waste-toner conveyance unit according to an embodiment.

As illustrated in FIG. 3A, the waste-toner conveyance unit 71 includes the conveying screw 70 inside a case 76. The case 76 defines a conveyance path in which the conveying screw 70 conveys the waste toner received from the belt cleaning unit 51 via the joint 75 (a flowing-in portion), downstream toward an outlet 85 (a discharge portion) illustrated in FIG. 2A. The waste-toner conveyance unit 71 is a component of the toner conveyance device according to this disclosure. The conveying screw 70 includes the cylindrical shaft 79 and the blade 73 spirally projecting, from the shaft 79, outward in the radial direction thereof. As the conveying screw 70 rotates, the waste toner is conveyed from the right to the left in FIGS. 3A to 3D.

The belt cleaning unit 51 extends in the width direction of the intermediate transfer belt 10 (perpendicular to the plane on which FIGS. 2A and 3A to 3D are drawn), and the outlet 64 is positioned on the front side of the apparatus. By contrast, the waste-toner conveyance unit 71 extends in the direction of rotation of the intermediate transfer belt 10 (the lateral direction in FIGS. 2A and 3A), and an opening 74 is disposed at an end thereof. Accordingly, a portion where the outlet 64 of the belt cleaning unit 51 overlaps with the opening 74 of the waste-toner conveyance unit 71 serves as the joint 75 between the belt cleaning unit 51 and the waste-toner conveyance unit 71.

The waste toner conveyed inside the belt cleaning unit 51 on the upper side falls through the joint 75 under the gravity (free fall) to the waste-toner conveyance unit 71 below the joint 75. The force of conveyance of the toner from the belt cleaning unit 51 to the waste-toner conveyance unit 71 by free fall is weaker than the force of conveyance by a conveying screw. Accordingly, in the joint 75, the possibility of aggregation, firm adhesion, and cross linkage of toner is higher, and the risk of clogging is higher. Therefore, in the present embodiment, an agitator 72 is disposed in the joint 75 to enhance the conveyance of waste toner in the joint 75. The agitator 72 vibrates up and down due to contact with the blade 73 of the conveying screw 70 and improves fluidity of toner in the joint 75, preventing clogging.

Figure 4:
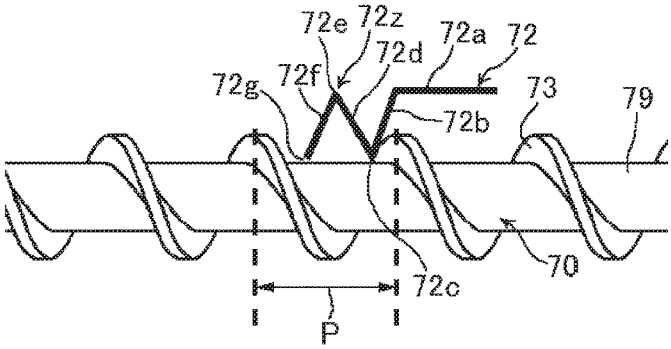
FIG. 4 is a schematic cross-sectional view of the agitator illustrated in FIGS. 3A to 3D.

Referring to FIG. 4, a structure of the agitator 72 is described.

Figure 5:
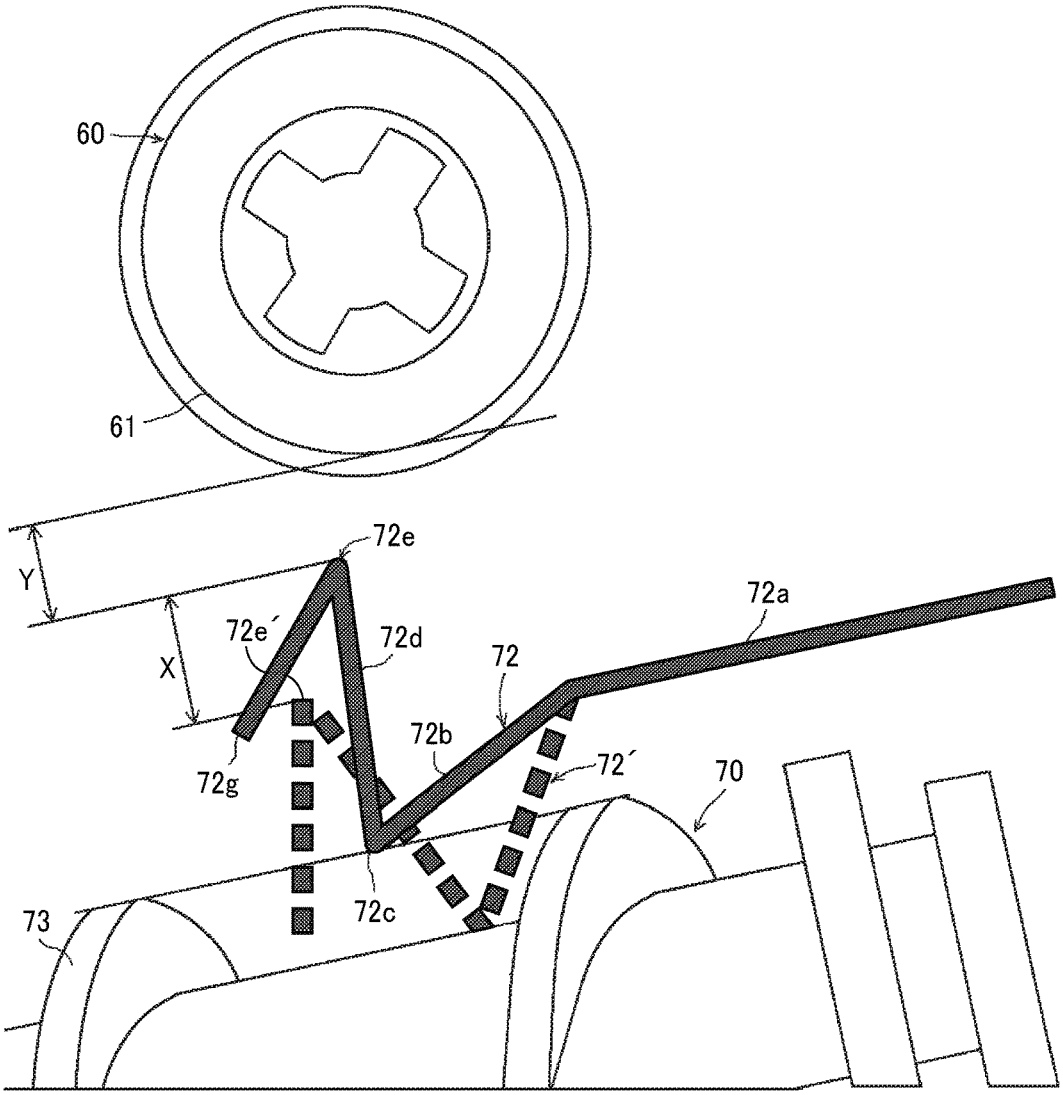
FIG. 5 is an enlarged view illustrating an amplitude of vibration of the agitator illustrated in FIG. 4.

As illustrated in 4, the agitator 72 serving as a toner loosener includes a loosening portion 72*z* and a flat base 72*a*. The loosening portion 72*z* loosens the toner, vibrated by the conveying screw 70. The base 72*a* supports (cantilevers) the loosening portion 72*z*. The loosening portion 72*z* includes, in the order from the base 72*a*, a first portion 72*b* extending obliquely downward from the base 72*a*, a first contact portion 72*c* that is a lower end of the first portion 72*b* and contacts the conveying screw 70, a second portion 72*d* extending obliquely upward from the first contact portion 72*c*, a top end 72*e* of the second portion 72*d*, a third portion 72*f* extending obliquely downward from the top end 72*e*, and a second contact portion 72*g* that is a lower end of the third portion 72*f* and contacts the conveying screw 70. The term "in the order of" used here means that, when viewed from the base 72*a* of the agitator 72 toward the distal end (i.e., the second contact portion 72*g*), the first contact portion 72*c* is precedent to the second contact portion 72*g*. In the longitudinal direction of the conveying screw 70, a distance from the base 72*a* to the second contact portion 72*g* is longer than a distance from the base 72*a* to the first contact portion 72*c*. The loosening portion 72*z* of the agitator 72 includes a mountain fold and a valley fold extending forward from the base 72*a* and does not include a portion folding back to the base 72*a*. In FIGS. 4 and 5, the loosening portion is folded up and down. By contrast, if the loosening portion is folded in the width direction, that is, back and forth relative to the base 72*a*, the distance from the base 72*a* to the second contact portion 72*g* may be shorter than the distance from the base 72*a* to the first contact portion 72*c*.

To manufacture the agitator 72, a piece of flat, elastic material, such as plastic film and polyester film, is folded. With this structure, repeated contact of the agitator 72 with the conveying screw 70 does not damage the conveying screw 70. Although one agitator including one loosening portion 72*z* is used in the present embodiment, alternatively, two or more agitators can be disposed side by side in a direction crossing the longitudinal direction of the conveying screw 70.

As illustrated in FIG. 4, the blade 73 of the conveying screw 70 has a pitch P (threads interval). The first contact portion 72*c* and the second contact portion 72*g* of the agitator 72 are located inside one pitch P and contact the blade 73 of the conveying screw 70 that rotates. The number of times of vibration of the agitator 72 while the conveying screw 70 rotates by one pitch P is identical to the number of contact portions of the agitator 72 located within one pitch P of the conveying screw 70.

Since two contact portions of the agitator 72 are located within one pitch P of the conveying screw 70 in the present embodiment, the agitator 72 vibrates up and down twice while the conveying screw 70 rotates by the one pitch P. Alternatively, the agitator 72 can further include a third contact portion so that the agitator 72 vibrates three times while the conveying screw 70 rotates by the one pitch P. Similarly, the agitator 72 can include four or more contact portions so that the agitator 72 vibrates four times or greater number of times while the conveying screw 70 rotates by the one pitch P.

To increase the amplitude of vertical vibration of the agitator 72, disposing the first contact portion 72*c* and the second contact portion 72*g* as close to the shaft 79 of the conveying screw 70 as possible is preferred. By contrast, the agitator 72 vibrates vertically as the first contact portion 72*c* and the second contact portion 72*g* contact not the shaft 79 but the blade 73. Accordingly, to alleviate a rotation load of the conveying screw 70, preferably, the first contact portion 72*c* and the second contact portion 72*g* are contactless with the shaft 79.

As illustrated in FIG. 4, the agitator 72 extends parallel to the longitudinal direction of the conveying screw 70 and vibrates vertically contacting the conveying screw 70. This structure enables adjustment of the number of times of vibration of the agitator 72, without receiving constraints of the pitch P of the conveying screw 70 and the length of the joint 75 (opening) between the belt cleaning unit 51 and the waste-toner conveyance unit 71 in the longitudinal direction of the conveying screw 70.

In the shape of the agitator 72, the mountain fold and the valley fold are combined, and the first contact portion 72*c* is located at the valley fold. Accordingly, as the depth of the valley fold is changed, the amplitude of vibration of the agitator 72 can be adjusted.

Next, referring to FIGS. 3A to 3D, descriptions are given below of vertical vibration of the agitator 72 caused by rotation of the conveying screw 70.

Figure 3B:
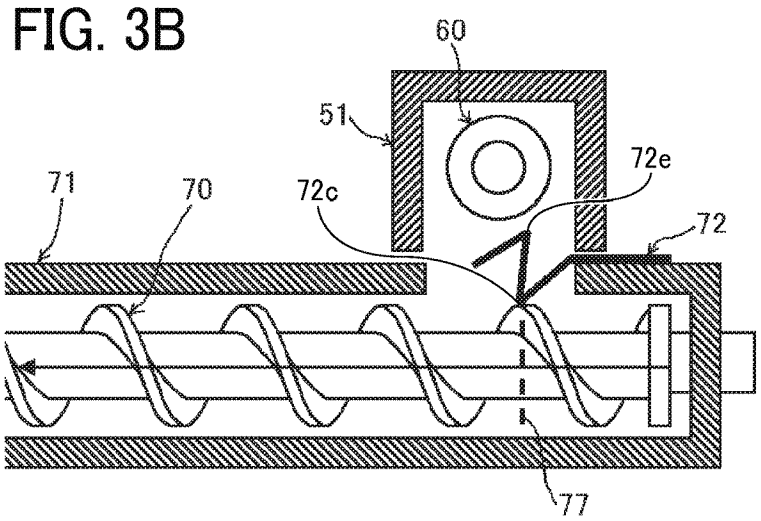
Figure 3C:
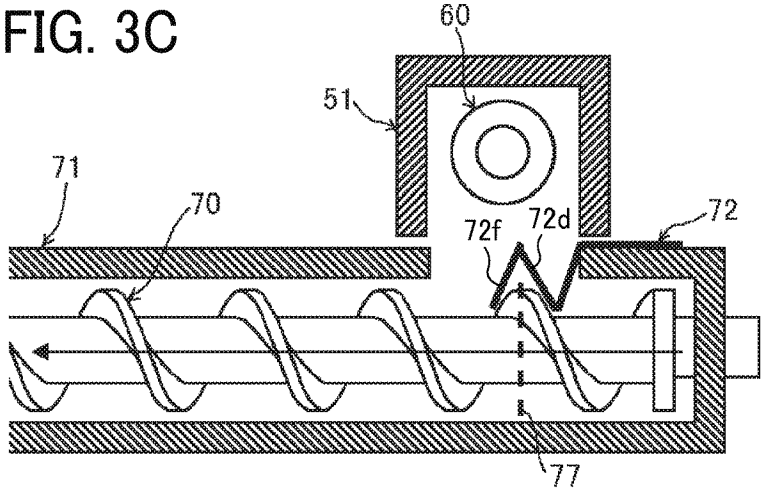
Figure 3D:
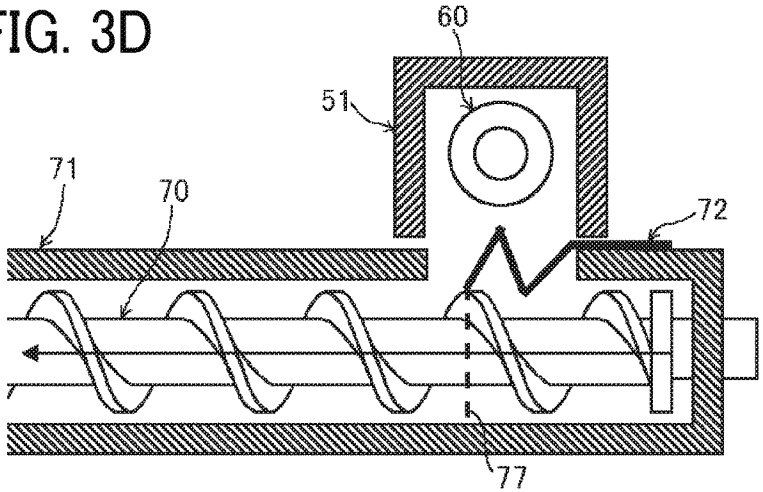

In an initial state illustrated in FIG. 3A, the agitator 72 is contactless with the conveying screw 70. As the conveying screw 70 rotates, a thread of the blade 73 indicated by broken lines 77 (hereinafter "thread 77") advances and contacts the first contact portion 72*c* of the agitator 72. At that time, the agitator 72 significantly vibrates upward, and the top end 72*e* thereof reaches a highest position as illustrated in FIG. 3B. This action is attained as follows. Since the agitator 72 extends forward, without being folded back to the base 72*a* (i.e., a cantilevered support), the force exerted from the blade 73 can be directly applied, without loss, to the first contact portion 72*c* and the top end 72*e* positioned downstream from the first contact portion 72*c* in the direction in which the thread 77 moves. Accordingly, the range in which the agitator 72 is vertically movable increases, improving the effect to loosening the toner. As the conveying screw 70 rotates further, the thread 77 of the blade 73 advances to between the second portion 72*d* and the third portion 72*f* and no longer contacts the conveying screw 70. Accordingly, the agitator 72 returns to the initial position due to elasticity as illustrated in FIG. 3C. The movement of the agitator 72 from the state illustrated in FIG. 3B to the state illustrated in FIG. 3C is first vibration, and the toner is loosened by the vibration in the joint 75.

As the conveying screw 70 rotates further, the thread 77 of the blade 73 advances and contacts the second contact portion 72*g* of the agitator 72. At that time, the agitator 72 again vibrates upward significantly, and the top end 72*e* thereof reaches a position illustrated in FIG. 3D, which is lower than the highest position illustrated in FIG. 3B. At that time, since the distance from the base 72*a* (the cantilevered support of the agitator 72) to the second contact portion 72*g* is longer than the distance from the base 72*a* to the first contact portion 72*c*, the force applied from the blade 73 to the second contact portion 72*g* is not restricted by the first contact portion 72*c*. Thus, loss of force is inhibited. Accordingly, the agitator 72 having a simple structure can effectively prevent clogging of the joint 75 with toner. As the conveying screw 70 rotates further, the blade 73 being in contact with the second contact portion 72*g* advances and no longer contacts the conveying screw 70. Accordingly, the agitator 72 returns to the initial position due to elasticity as illustrated in FIG. 3A. The movement of the agitator 72 from the state illustrated in FIG. 3D to the state illustrated in FIG. 3A is second vibration, and the toner is again loosened by the vibration in the joint 75.

The above-described two times of vertical vibration of the agitator 72 (movement in the order from FIGS. 3A, 3B, 3C, 3D, and 3A) occurs while the conveying screw 70 rotates by one pitch P. White the conveying screw 70 rotates, the agitator 72 repeats this vertical vibration. Accordingly, the agitator 72 loosens the toner across the joint 75, in which aggregation, firm adhesion, and cross linkage of toner are likely to occur. Thus, with a simple structure, the joint 75 is effectively prevented from clogging with the toner.

If the number (area) of the agitator 72 is large, the toner conveyance passage may be reduced. If the number of times of vibration is small, toner may accumulate on the agitator 72. Thus, depending on the installation conditions, the agitator 72 may cause clogging with toner. Accordingly, it is preferred to limit the number (or area) of the agitator 72 to a bare minimum and cause the agitator to vibrate a multiple number of times while the conveying screw rotates by one pitch.

As described in relation to FIGS. 2A to 2C, after a print job completes, the controller 90 causes the drive motor 80 to reversely rotate the secondary-transfer backup roller 12 so as to reversely rotate the intermediate transfer belt 10 by, for example, 2 mm. Since the intermediate transfer belt 10 is reversely rotated after completion of the print job, at that time, the amount of reverse rotation of the gear 78 of the conveying screw 70 is preferably smaller than one pitch of the conveying screw 70. This configuration can prevent the reversely rotating blade 73 of the conveying screw 70 from contacting the first contact portion 72*c* and the second contact portion 72*g* of the agitator 72. Thus, the agitator 72 can be prevented from being crushed by the blade 73.

FIG. 5 is an enlarged cross-sectional view illustrating the amplitude of vibration of the agitator 72.

In FIG. 5, broken lines 72' represent the agitator 72 being in the initial state illustrated in FIG. 3A, and a top end 72*e*' thereof is farthest from the blade 61 of the conveying screw 60 of the belt cleaning unit 51. In FIG. 5, the agitator 72 represented by solid lines is equivalent to the state illustrated in FIG. 3B, and the top end 72*e* of the agitator 72 is at the highest position and closest to the blade 61 of the conveying screw 60. At that time, a distance X between the top end 72*e* and the top end 72*e*' is, for example, 2.9 mm and equivalent to a largest amplitude of vibration of the agitator 72 (maximum movable range of the top end 72*e*).

By contrast, a distance Y between the top end 72*e* and the blade 61 is, for example, 2.2 mm. To effectively loosen, with the vertical vibration of the agitator 72, the toner falling under the gravity from the conveying screw 60 to the conveying screw 70, preferably, the distance Y between the top end 72*e* and the blade 61 of the conveying screw 60 is small. The distance Y, however, should be sufficient to prevent the top end 72*e* from contacting the blade 61. Accordingly, in bending the agitator 72 to form the mountain fold and the valley fold, the depth of the valley fold, constructed of the first portion 72*b* extending from the base 72*a* and the second portion 72*d*, is changed to adjust the magnitude (amplitude) of vibration of the agitator 72.

Note that the conveying screw 70 is inclined to the lower left in FIG. 5 to use the gravity to facilitate conveyance of the toner from upstream to downstream.

Figure 6:
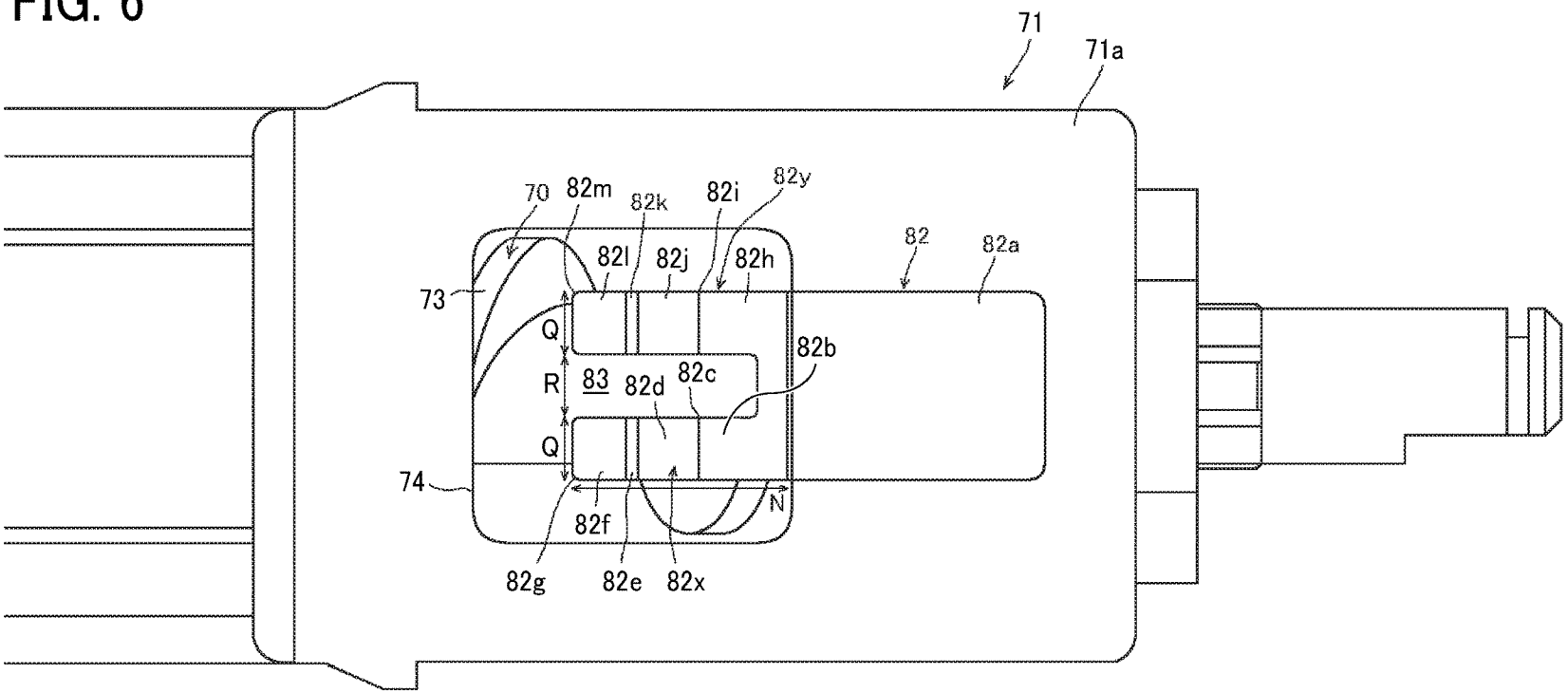
FIG. 6 is a cross-sectional view of an agitator according to another embodiment.

FIG. 6 is a cross-sectional view of an agitator according to another embodiment.

An agitator 82 illustrated in this drawing serves as a toner loosener and includes two loosening portions, first and second loosening portions 82*x* and 82*y*, and a flat base 82*a* to cantilever the first and second loosening portions 82*x* and 82*y*. The first and second loosening portions 82*x* and 82*y* loosen the toner, vibrated by the conveying screw 70. The first and second loosening portions 82*x* and 82*y* extend from the common base 82*a* and disposed side by side in the direction crossing the longitudinal direction of the conveying screw 70. With this structure, the conveying screw 70 having a spiral shape vibrates the first and second loosening portions 82*x* and 82*y* at different timings. Accordingly, clogging with toner can be prevented more effectively. Although the agitator 82 includes two loosening portions disposed side by side in a direction crossing the longitudinal direction of the conveying screw 70, the structure of the agitator 82 is not limited thereto. For example, the agitator 82 can have three or more loosening portions. As described above, the agitator 82 is made of a piece of flat, elastic material, such as plastic film and polyester film, which is folded.

The first and second loosening portions 82*x* and 82*y* are similar in structure to the loosening portion 72*z* illustrated in FIG. 4. That is, the first loosening portion 82*x* includes, in the order from the base 82*a*, a first portion 82*b* extending obliquely downward from the base 82*a*, a first contact portion 82*c* that is a lower end of the first portion 82*b* and contacts the conveying screw 70, a second portion 82*d* extending obliquely upward from the first contact portion 82*c*, a top end 82*e* of the second portion 82*d*, a third portion 82*f* extending obliquely downward from the top end 82*e*, and a second contact portion 82*g* that is a lower end of the third portion 82*f* and contacts the conveying screw 70. In the longitudinal direction of the conveying screw 70, a distance from the base 82*a* to the second contact portion 82*g* is longer than a distance from the base 82*a* to the first contact portion 82*c*.

Similarly, the second loosening portion 82*y* includes, in the order from the base 82*a*, a first portion 82*h* extending obliquely downward from the base 82*a*, a first contact portion 82*i* that is a lower end of the first portion 82*h* and contacts the conveying screw 70, a second portion 82*j* extending obliquely upward from the first contact portion 82*i*, a top end 82*k* of the second portion 82*j*, a third portion 82*l* extending obliquely downward from the top end 82*k*, and a second contact portion 82*m* that is a lower end of the third portion 82*l* and contacts the conveying screw 70. In the longitudinal direction of the conveying screw 70, a distance from the base 82*a* to the second contact portion 82*m* is longer than a distance from the base 82*a* to the first contact portion 82*i*.

Additionally, since the first and second loosening portions 82*x* and 82*y* are similar in structure, the first contact portions 82*c* and 82*i*, the top ends 82*e* and 82*k*, and the second contact portions 82*g* and 82*m* are respectively positioned at the same distance from the base 82*a* in the longitudinal direction of the conveying screw 70.

Each of the first and second loosening portions 82*x* and 82*y* has a width Q in the direction perpendicular to the conveying screw 70. The widths thereof are common. A clearance 83 having a width R is secured between the first loosening portion 82*x* and the second loosening portion 82*y*, and the width R is identical to the width Q of the first loosening portion 82*x* and the second loosening portion 82*y*. Providing the clearance 83 between the first loosening portion 82*x* and the second loosening portion 82*y* is advantageous in preventing accumulation of the toner in the joint 75 since the toner falling under the gravity from the belt cleaning unit 51 positioned above the agitator 82 can pass through the clearance 83.

Note that the width R of the clearance 83 is preferably equal to or greater than the width Q between the first loosening portion 82*x* and the second loosening portion 82*y*.

Further, for example, each of the second portions 82*d* and 82*j* can have through holes at or adjacent to a center thereof. Providing the through hole is advantageous in preventing accumulation of the toner in the joint 75 since the toner falling from above under the gravity can fall through the through hole to the conveying screw 70 and be conveyed by the conveying screw 70. The position and the size of the through hole are determined to secure strength and elasticity of the first and second loosening portions 82*x* and 82*y*.

In the present embodiment, the opening 74 is, for example, rectangular and 10 mm in length (in the longitudinal direction of the conveying screw 70) and width. The first loosening portion 82*x* and the second loosening portion 82*y* have a length N that is about three fourth of the lateral length (in the lateral direction in FIG. 6) of the opening 74. However, the length N of the first loosening portion 82*x* and the second loosening portion 82*y* can be longer or shorter than such a length considering the lateral length of the opening 74, in which the agitator 82 is disposed, and the effect of the agitator 82 to loosen the toner.

The base 82*a* of the agitator 82 is secured to an upstream portion of an upper face 71*a* of the waste-toner conveyance unit 71 in the direction of conveyance of the conveying screw 70, for example, with adhesive or by screwing. By contrast, a downstream end of the agitator 82 in the direction of conveyance of the conveying screw 70 is not attached but is a free end. With this structure, when the agitator 82 contacts the rotating conveying screw 70, the agitator 82 is not shifted vertically in FIG. 6 or is not caught by the conveying screw 70. Thus, the free end of the agitator 82 can smoothly vibrate vertically.

Alternatively, the base 82*a* of the agitator 82 may be secured to a downstream portion of the upper face 71*a* of the waste-toner conveyance unit 71 in the direction of conveyance of the conveying screw 70, and an upstream end of the agitator 82 in the direction of conveyance of the conveying screw 70 may be a free end. However, in this case, the rotating conveying screw 70 squashes the free end of the agitator 82, inhibiting the agitator 82 from vibrating. Alternatively, there is a risk that the conveying screw 70 engages the free end of the agitator 82 and locking the agitator 82. Therefore, making the downstream end of the agitator 82 in the direction of conveyance of the conveying screw 70*a* free end is preferred.

Although the base 82*a* of the agitator 82 is secured to the upper face 71*a* of the waste-toner conveyance unit 71 in the present embodiment, in another embodiment, the agitator 82 is disposed on the side of the belt cleaning unit 51 in the joint 75 so that the agitator 82 is vibrated vertically by the conveying screw 60. Specifically, referring to FIG. 2B, when the agitator 82 is disposed in the outlet 64 of the belt cleaning unit 51 or the joint 75, the agitator 82 is disposed parallel to the longitudinal direction of the conveying screw 60 and upside down from the position illustrated in FIG. 4.

At that time, the base 82*a* of the agitator 82 is secured to an upstream portion (on the right side in FIG. 2B) of the case 52 of the belt cleaning unit 51 in the direction of conveyance of the conveying screw 60, while a downstream end of the agitator 82 in the direction of conveyance of the conveying screw 60 is not secured but is a free end.

An additional waste-toner conveyance unit can be provided downstream from the waste-toner conveyance unit 71, to convey the toner received from the waste-toner conveyance unit 71. In such a structure, the agitator 82 can be disposed, in addition to the joint 75, in a joint between the waste-toner conveyance unit 71 and the additional waste-toner conveyance unit, on the side of the upstream waste-toner conveyance unit 71, so that the agitator 82 is vibrated vertically by the conveying screw 70.

By contrast, in the structure in which the agitator 82 is disposed in the joint between the waste-toner conveyance unit 71 and the additional waste-toner conveyance unit in addition to the joint 75, the agitator 82 can be disposed in the downstream waste-toner conveyance unit to be vibrated vertically by a conveying screw of the downstream waste-toner conveyance unit.

Figure 7:
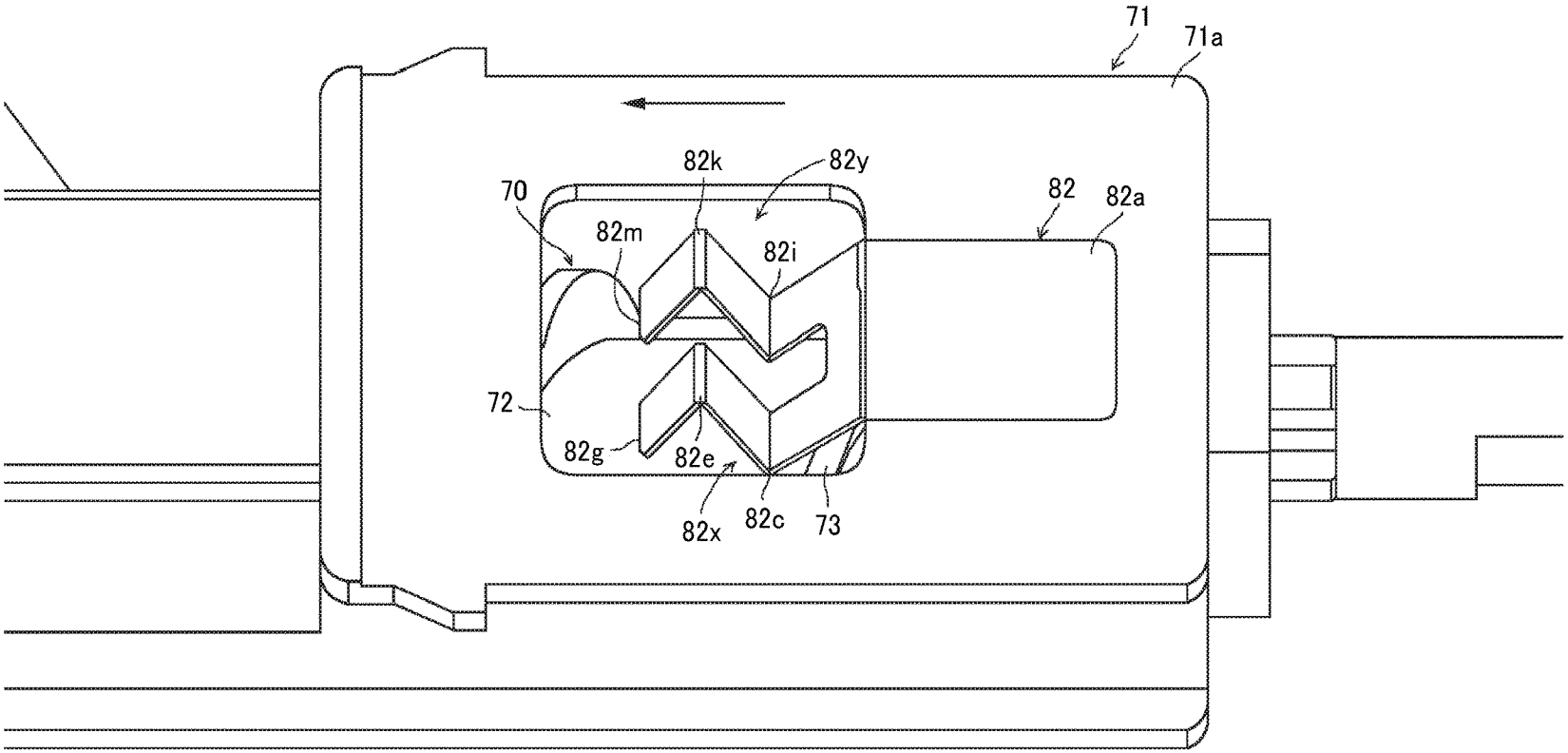
FIG. 7 is a perspective view of the agitator illustrated in FIG. 6.
Figure 8:
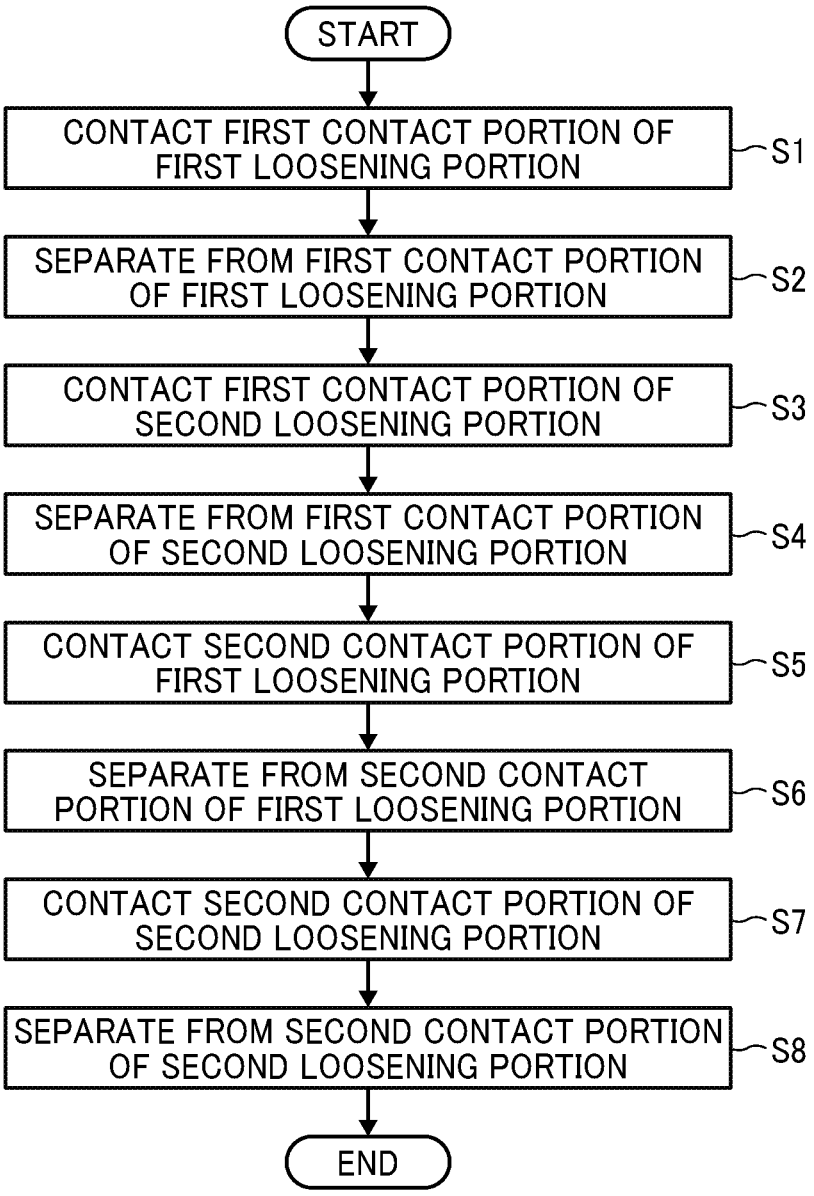
FIG. 8 is a flowchart illustrating a sequence of contact and separation between the agitator illustrated in FIGS. 6 and 7 and a blade of a conveying screw.

Next, the contact of the conveying screw 70 with the agitator 82 is described with reference to FIGS. 7 and 8. FIG. 7 is a perspective view of the agitator 82 illustrated in FIG. 6. FIG. 8 is a flowchart illustrating a sequence of contact and separation of the blade 73 of the conveying screw 70 with the agitator 82.

FIG. 7 illustrates an initial state in which the agitator 82 is contactless with the conveying screw 70, which is similar to the state illustrated in FIG. 3A.

As illustrated in FIG. 7, the blade 73 of the conveying screw 70 is disposed obliquely to the cylindrical shaft 79. Accordingly, as the conveying screw 70 rotates and the blade 73 moves forward from the right to the left in FIG. 7 as indicated by an arrow, the blade 73 initially contacts the first contact portion 82*c* of the first loosening portion 82*x* of the agitator 82. At that time, the first loosening portion 82*x* significantly vibrates upward, and the top end 82*e* thereof reaches a highest position in a movable range (S1 in FIG. 8). At that time, the first loosening portion 82*x* is at the position illustrated in FIG. 3B.

As the blade 73 further advances, the blade 73 separates from the first contact portion 82*c* of the first loosening portion 82*x* of the agitator 82. Accordingly, the first loosening portion 82*x* returns to the initial position due to elasticity (S2 in FIG. 8). At that time, the first loosening portion 82*x* is at the position illustrated in FIG. 3C.

As the blade 73 moves further forward, the blade 73 contacts the first contact portion 82*i* of the second loosening portion 82*y* of the agitator 82. At that time, the second loosening portion 82*y* significantly vibrates upward, and the top end 82*k* thereof reaches a highest position in a movable range (S3 in FIG. 8). At that time, the second loosening portion 82*y* is at the position illustrated in FIG. 3B.

As the blade 73 further advances, the blade 73 separates from the first contact portion 82*i* of the second loosening portion 82*y* of the agitator 82. Accordingly, the second loosening portion 82*y* returns to the initial position due to elasticity (S4 in FIG. 8). At that time, the second loosening portion 82*y* is at the position illustrated in FIG. 3*c*.

As the blade 73 moves further forward, the blade 73 contacts the second contact portion 82*g* of the first loosening portion 82*x* of the agitator 82. At that time, the first loosening portion 82*x* vibrates upward again, and the top end 82*e* thereof reaches a position lower than the highest position (S5 in FIG. 8). At that time, the first loosening portion 82*x* is at the position illustrated in FIG. 3D.

As the blade 73 further advances, the blade 73 separates from the second contact portion 82*g* of the first loosening portion 82*x* of the agitator 82. Accordingly, the first loosening portion 82*x* returns to the initial position due to elasticity (at 56 in FIG. 8). At that time, the first loosening portion 82*x* is at the position illustrated in FIG. 3A.

As the blade 73 moves further forward, the blade 73 contacts the second contact portion 82*m* of the second loosening portion 82*y* of the agitator 82. At that time, the second loosening portion 82*y* vibrates upward again, and the top end 82*k* thereof reaches a position lower than the highest position (S7 in FIG. 8). At that time, the second loosening portion 82*y* is at the position illustrated in FIG. 3D.

As the blade 73 further advances, the blade 73 separates from the second contact portion 82*m* of the second loosening portion 82*y* of the agitator 82. Accordingly, the second loosening portion 82*y* returns to the initial position due to elasticity (at S8 in FIG. 8). At that time, the second loosening portion 82*y* is at the position illustrated in FIG. 3A.

As described above, from the initial state illustrated in FIG. 3A, the agitator 82 repeats steps from S1 to S8 while the conveying screw 70 rotates by one pitch.

In short, since the agitator 82 includes two loosening portions, the first and second loosening portions 82*x* and 82*y* disposed side by side in the direction crossing the longitudinal direction of the conveying screw 70, the spiral blade 73 contacts the first and second loosening portions 82*x* and 82*y* at different timings. Specifically, the blade 73 sequentially contacts the first contact portion 82*c*, the first contact portion 82*i*, the second contact portion 82*g*, and the second contact portion 82*m*. Accordingly, the first and second loosening portions 82*x* and 82*y* repeatedly vibrate vertically not simultaneously but at different timings. Since the first and second loosening portions 82*x* and 82*y* move at different timings, the effect of loosening toner in the joint between units can increase, preventing stagnant of toner more effectively.

Not limited to the structure illustrated in FIG. 7, the agitator 82 can be configured so that the first and second loosening portions 82*x* and 82*y* simultaneously contact the blade 73 disposed obliquely and simultaneously vibrate vertically. Specifically, the first contact portion 82*i* of the second loosening portion 82*y* is designed to contact the blade 73 simultaneously when the blade 73 contacts the first contact portion 82*c* of the first loosening portion 82*x*. That is, the first contact portion 82*i* of the second loosening portion 82*y* is shifted to the downstream side in the conveyance direction of the conveying screw 70 (to the right in FIG. 7) from the first contact portion 82*c* of the first loosening portion 82*x* in conformity with inclination of the blade 73. This applies to the relative positions between the second contact portion 82*g* of the first loosening portion 82*x* and the second contact portion 82*m* of the second loosening portion 82*y*.

Note that, although the toner loosener is disposed in the joint 75 (a flowing-in portion) in the above-described embodiment, the toner looser can be disposed in the outlet 85 (a discharge portion) or each of the joint 75 and the outlet 85. Disposing the toner loosener in the outlet 85 (a discharge portion) can prevent the toner from stagnating in the portion where the toner is forwarded from the conveying screw 70 to the duct 81, thereby smoothly transporting the toner to the waste-toner container 86.

The descriptions above concern the conveying screw to convey waste toner and disposing the toner loosener in the flowing-portion or the discharge portion. Alternatively, a conveying screw to convey toner can be disposed in the developing device or upstream therefrom and a toner loosener can be disposed in a flowing-in portion thereto or a discharge portion therefrom. Such a structure can prevent stagnant of toner in the flowing-in portion to or a discharge portion from the conveying screw, similarly.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A toner conveyance device, comprising:

a conveying screw to convey toner from a flowing-in portion of a conveyance path to a discharge portion of the conveyance path; and a toner loosener, disposed in at least one of the flowing-in portion and the discharge portion, the toner loosener including:

at least one loosening portion, vibrateable by contact with the conveying screw; and a support to cantilever the at least one loosening portion, wherein the at least one loosening portion includes at least a first contact portion and a second contact portion, the second contact portion being disposed relatively farther from the support than the first contact portion, and wherein a distance from the support to the second contact portion is relatively longer than a distance from the support to the first contact portion in a longitudinal direction of the conveying screw, and wherein the first contact portion and the second contact portion are disposed between portions of a blade revolving around the conveying screw, and are configured to sequentially contact, in the longitudinal direction of the conveying screw, a same portion of the blade upon the conveying screw completing one revolution.

2. The toner conveyance device according to claim 1, wherein the first contact portion and the second contact portion are disposed within one pitch of the conveying screw.

3. The toner conveyance device according to claim 1, wherein an upstream side of the support of the toner loosener, in a direction of conveyance of the conveying screw, is secured, and wherein a downstream end of the toner loosener, in the direction of conveyance of the conveying screw, is a free end.

4. The toner conveyance device according to claim 1, wherein the toner loosener is an agitator extending parallel to the longitudinal direction of the conveying screw, and wherein the agitator is vertically vibrateable by contact with the conveying screw.

5. The toner conveyance device according to claim 1, wherein the at least one loosening portion includes a plurality of loosening portions arranged in a direction crossing the longitudinal direction of the conveying screw.

6. The toner conveyance device according to claim 5, wherein, in the direction crossing the longitudinal direction of the conveying screw, an interval between adjacent two loosening portions of the plurality of loosening portions is not relatively smaller than a width of each of the plurality of loosening portions.

7. The toner conveyance device according to claim 1, wherein the at least one loosening portion of the toner loosener includes a mountain fold and a valley fold, and wherein the first contact portion is disposed at the valley fold.

8. An image forming apparatus comprising:

an image bearer to bear a toner image; and the toner conveyance device according to claim 1, to convey the toner collected from the image bearer.

9. The image forming apparatus according to claim 8, further comprising:

a roller to rotate together with the image bearer;

a first gear attached to the roller; and a second gear attached to the conveying screw, the second gear to receive a drive force transmitted from the first gear, wherein the image bearer is reversely rotatable after completion of a print job such that an amount of reverse rotation of the second gear is relatively smaller than one pitch of the conveying screw.

10. A toner conveyance device comprising:

a first conveying screw to convey toner from a flowing-in portion of a conveyance path to a discharge portion of the conveyance path;

a cleaning unit to collect toner from an image bearer, the cleaning unit being disposed upstream from the flowing-in portion of the conveyance path in a toner conveyance direction in the toner conveyance device;

a second conveying screw to convey toner in the cleaning unit; and a toner loosener disposed on a side of the cleaning unit in the flowing-in portion of the conveyance path, the toner loosener including:

at least one loosening portion, vibrateable by contact with the second conveying screw; and a support to cantilever the at least one loosening portion, wherein the at least one loosening portion includes at least a first contact portion and a second contact portion, the second contact portion being disposed relatively farther from the support than the first contact portion, and wherein a distance from the support to the second contact portion is relatively longer than a distance from the support to the first contact portion in a longitudinal direction of the second conveying screw, and wherein the first contact portion and the second contact portion are disposed between portions of a blade revolving around the conveying screw, and are configured to sequentially contact, in the longitudinal direction of the conveying screw, a same portion of the blade upon the conveying screw completing one revolution.

11. An image forming apparatus comprising:

the image bearer to bear a toner image; and the toner conveyance device according to claim 10, to convey the toner collected from the image bearer.

12. The toner conveyance device according to claim 1, wherein the toner loosener includes a number of contact portions including at least two contact portions, the at least two contact portions disposed between portions of a blade revolving around the conveying screw, and the number of contact portions of the toner loosener equaling a number of vibrations of the toner loosener upon the conveying screw completing one revolution.

13. The toner conveyance device according to claim 10, wherein the toner loosener includes a number of contact portions including at least two contact portions, the at least two contact portions disposed between portions of a blade revolving around the conveying screw, and the number of contact portions of the toner loosener equaling a number of vibrations of the toner loosener upon the conveying screw completing one revolution.

14. An image forming apparatus, comprising:

an image bearer to bear a toner image;

a toner conveyance device to convey the toner collected from the image bearer, the toner conveyance device including a conveying screw to convey the toner from a flowing-in portion of a conveyance path, to a discharge portion of the conveyance path, and a toner loosener, disposed in at least one of the flowing-in portion and the discharge portion, the toner loosener including at least one loosening portion, vibrateable by contact with the conveying screw, and a support to cantilever the loosening portion, wherein the at least one loosening portion includes at least a first contact portion and a second contact portion, the second contact portion being disposed relatively farther from the support than the first contact portion, and wherein a distance from the support to the second contact portion is relatively longer than a distance from the support to the first contact portion, in a longitudinal direction of the conveying screw;

a roller to rotate together with the image bearer;

a first gear attached to the roller; and a second gear attached to the conveying screw, the second gear to receive a drive force transmitted from the first gear, wherein the image bearer is reversely rotatable after completion of a print job such that an amount of reverse rotation of the second gear is relatively smaller than one pitch of the conveying screw.

15. The toner conveyance device according to claim 14, wherein the first contact portion and the second contact portion are disposed between portions of a blade revolving around the conveying screw, and are configured to sequentially contact, in the longitudinal direction of the conveying screw, a same portion of the blade upon the conveying screw completing one revolution.

16. The toner conveyance device according to claim 14, wherein the toner loosener includes a number of contact portions including at least two contact portions, the at least two contact portions disposed between portions of a blade revolving around the conveying screw, and the number of contact portions of the toner loosener equaling a number of vibrations of the toner loosener upon the conveying screw completing one revolution.

* * * * *